US006130860A

United States Patent [19]

Suzuki

[11] Patent Number: 6,130,860

[45] Date of Patent: Oct. 10, 2000

[54] DEVICES AND METHODS FOR SPECIFYING A TIME WHEN A SPECIFIED PROCESS WAS PERFORMED

[75] Inventor: Hiroaki Suzuki, Musashimurayama, Japan

[73] Assignee: Casio Computer Co., Ltd., Tokyo, Japan

[21] Appl. No.: 08/855,930

[22] Filed: May 14, 1997

[30] Foreign Application Priority Data

May 16, 1996 [JP] Japan ..... 8-121228

[51] Int. Cl.[7] ..... G04B 19/20

[52] U.S. Cl. ..... 368/10; 368/47

[58] Field of Search ..... 368/10, 47, 48–61, 368/46

[56] References Cited

U.S. PATENT DOCUMENTS

| | | | |
|---|---|---|---|
| 4,057,785 | 11/1977 | Furniss et al. . | |
| 4,779,199 | 10/1988 | Yoneda et al. | 368/10 |
| 5,136,285 | 8/1992 | Okuyama | 340/870 |
| 5,583,831 | 12/1996 | Churchill et al. | 368/10 |
| 5,719,825 | 2/1998 | Dotter | 368/10 |
| 5,724,316 | 3/1998 | Brunts | 368/10 |

FOREIGN PATENT DOCUMENTS

| | | |
|---|---|---|
| 0 077 249A1 | 4/1983 | European Pat. Off. . |
| WO 95/32480 | 11/1995 | WIPO . |

*Primary Examiner*—Bernard Roskoski
*Attorney, Agent, or Firm*—Frishauf, Holtz, Goodman, Langer & Chick, P.C.

[57] ABSTRACT

A transmitter includes a time measuring unit. The transmitter also includes a time information storage unit for storing information on the time measured by the time measuring unit when a specified process was performed. The transmitter is responsive to an instruction of transmission to transmit to a receiver information on the time difference between the time measured by the time measuring unit and the time whose information is stored in the time information storage unit. The receiver calculates the time when the specified process was performed by the transmitter on the basis of the information on the received time difference and information on the current time obtained by a time measuring unit. Thus, although the transmitter has no current time measuring unit, the receiver is capable of specifying the time when the specified process was performed.

8 Claims, 11 Drawing Sheets

DEVICES AND METHODS FOR SPECIFYING A TIME WHEN A SPECIFIED PROCESS WAS PERFORMED

BACKGROUND OF THE INVENTION

The present invention relates to electronic devices and methods for specifying a time when a specified process was performed, and to transmitters and receivers for use in the electronic devices.

Conventionally, some electronic devices such as facsimile devices/pagers are known which record/store the time when they receive/transmit data from/to other electronic devices. In the case of the electronic device which stores the time when it transmits data, the time output from a clock circuit provided in the electronic device thereof is used whereas in the case of the electronic device which stores the time when it receives data, the time output from a clock circuit provided in the electronic device is used.

There are many demands for transmission of some obtained target data along with data on the time when the target data was received (and not along with data on the time when the target data was transmitted), when the time data is significant. To this end, the obtained target data and the data on the time when the target data was obtained are temporarily stored in a memory and then transmitted to the requesting end.

For example, in the case of an in-home examination and treatment where a patient measures his or her living body data such as his or her pulse, blood pressure or electrocardiogram waveform at his or her home, and sends the data over a telephone line to medical facilities, it is necessary to further send data on the time when the living body data were measured. If otherwise, it cannot be known when the target data were obtained, and the target data cannot serve as a good reference for diagnosis.

In addition, for example, a time when an image was picked up by an electronic still camera having a communication function can be desired to be sent along with the picked-up image.

When data on the time when such data to be sent is stored and sent, a clock circuit is required to be provided at the transmitting end. In this case, the time recorded by the clock circuit is required to be accurate at all times.

If a clock circuit is also provided at the receiving end, the sending and receiving ends are required to be synchronized. Thus, in order to satisfy such requirement at all times, the transmitting and receiving ends are continuously required to be synchronized or corrected with respect to time, which is very troublesome.

If living body data measuring devices are required for the respective measuring items, for example, if separate devices such as electrocardiograms and pulse meters measure the corresponding data and send same, in an in-home examination and treatment, the respective devices are required to be synchronized, which is very troublesome.

It is therefore an object of the present invention to provide electronic devices which include a transmitter and a receiver, and which are capable of storing and specifying a time when the data to be transmitted was obtained even when no current time measuring means is provided in the transmitter.

Another object of the present invention is to provide electronic devices and methods which eliminate troublesome synchronization between the transmitter and receiver even when a current time measuring means is provided in the transmitter, and to further provide transmitters, receivers and storage mediums which are operable with such electronic devices.

SUMMARY OF THE INVENTION

In order to achieve the above objects, the present invention provides an electronic device comprising a transmitter which transmits receiver time difference information indicative of a difference between a time measured by a time measuring means when the time difference information is transmitted to the receiver and a time when a specified processing was performed. Information on the latter time is stored in a time information storage means. The receiver calculates the time when the transmitter performed the special processing, on the basis of the received time difference information and current time information obtained from the time measuring means. Thus, even when no current time measuring (or recording) means is provided in the transmitter, the time when the specified processing was performed is specified.

DESCRIPTION OF THE PREFERRED EMBODIMENTS

The inventive electronic devices apply to in-home examination and treatment systems, communication devices such as facsimile devices/pagers which receive and indicate the time when the other party sent data, and image storage devices such as digital cameras. An in-home examination and treatment system using the inventive electronic device will be illustrated as an embodiment with reference to the accompanying drawings.

A. Outline of the Embodiment

Figure 1:
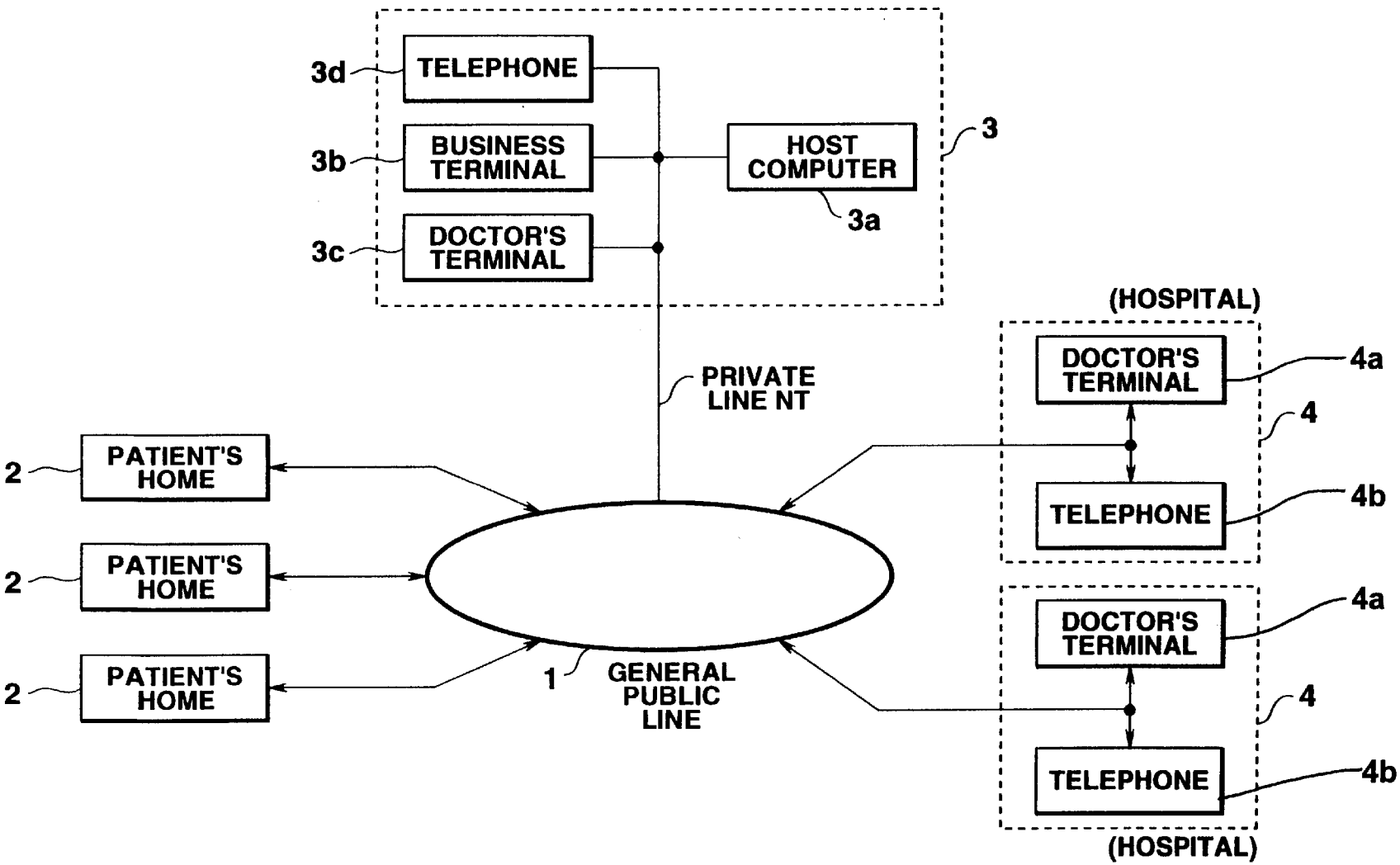
FIG. 1 is a schematic block diagram of one embodiment of the present invention.

FIG. 1 is a block diagram of an in-home examination and treatment system as an embodiment of the present invention. In FIG. 1, reference numeral 1 denotes a general public (telephone) line. Reference numeral 2 denotes a patient's home which is connected over the general public line 1 to the medical center 3 to be described later in more detail.

Provided in the patient's home 2 is a home device which sends the medical center 3 a series of measured living body data such as the patient's blood pressure, body temperature, pulses and cardiogram waveform and the corresponding data on the respective times when those data were measured. The structure of the home device will be described in more detail later.

The medical center 3 is comprised of a host computer 3*a* connected via a private line NT to the general public line 1, a business terminal 3*b* connected to the host computer 3*a*, a doctor's terminal 3*c* and a telephone set 3*d*. The host computer 3*a* supervises and controls transmission/receipt of data between the patient's home 2 and the medical facilities 4 over the general public line 1. More specifically, the host computer 3*a* stores data on the patient's living body up-loaded by the patient's home 2 and sends patient's data to the medical facilities 4 in accordance with a down-load request from the medical facilities 4.

Medical facilities 4 such as a hospital or a clinic, include a doctor's terminal 4*a* and a telephone set 4*b*. The medical facilities 4 use the doctor's terminal 4*a* to access the host computer 3*a* over the general public line 1 to thereby down load appropriate data on the patient and examine the patient.

The patient's home 2 transmits the patient's living body data to the medical center 3, which sends the living body data to the medical facilities 4 for diagnosing purposes. As the result of the diagnosis, the medical facilities transmit to the patient's home 2 and the medical center 3 data on a method of treatment appropriate for the patient, etc.

According to such in-home examination and treatment system, the doctor is able to handle the patient's living body data as a time-series history on the basis of the storage data in the medical center 3, so that the doctor is able to make a medical examination and treatment similar to his or her regular rounds without the need for on-line monitoring. The patient is able to receive the doctor's diagnosis even at his or her home whereas the doctor is able to examine the patient at his or her home between interview examinations/treatments of other patients in the hospital.

B. Structure of Home Device

The structure of the home device which handles a patient's living body data as a time series history and sends the data to the host computer 3*a* will be described with reference to FIGS. 2–5.

Figure 2:
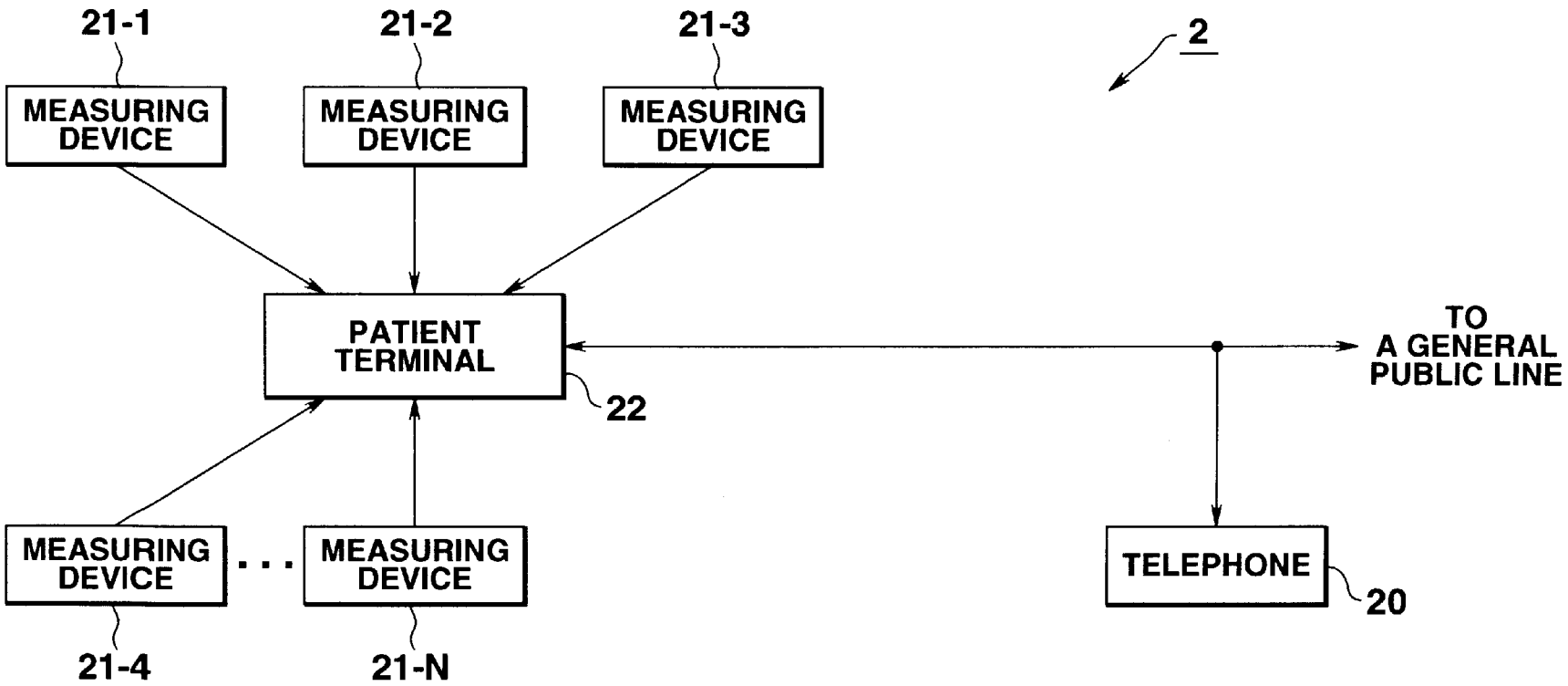
FIG. 2 is a block diagram of a home device provided in a patient's home of FIG. 1.

(1) Whole Structure:

FIG. 2 is a block diagram of the whole structure of a home device provided in a patient's home 2. In FIG. 2, reference numeral 20 denotes a telephone set, and reference numerals 21-1 to 21-N each denote a device which measures the patient's blood pressure, body temperature, pulses, cardiogram waveform, etc. Those devices send by radio data which includes the respective measured living body data and corresponding time difference data DT (to be described later).

Reference numeral 22 denotes a patient terminal which receives the respective data sent by radio from the corresponding measuring devices 21-1 to 21-N, and converts the respective received data to time-series living body data on the basis of the corresponding time difference data DT. That is, data on the respective times when the corresponding living body data were measured are added to the corresponding living body data.

The patient terminal 22 then modulates those-series data to provide a voice signal, which is then sent over the general public line 1 to the host computer 3*a*.

(2) Structure of Measuring Devices 21-1 to 21-N:

The structure of each of the measuring devices 21-1 to 21-N will be described with reference to FIG. 3. Each of the measuring devices 21-1 to 21-N has a structure shown by reference numeral 21 in FIG. 3. Those measuring devices are different one from another only in that a sensor depending on an object to be measured is used and that a measuring circuit especially constituted so as to obtain data on the object to be measured is used.

Figure 3:
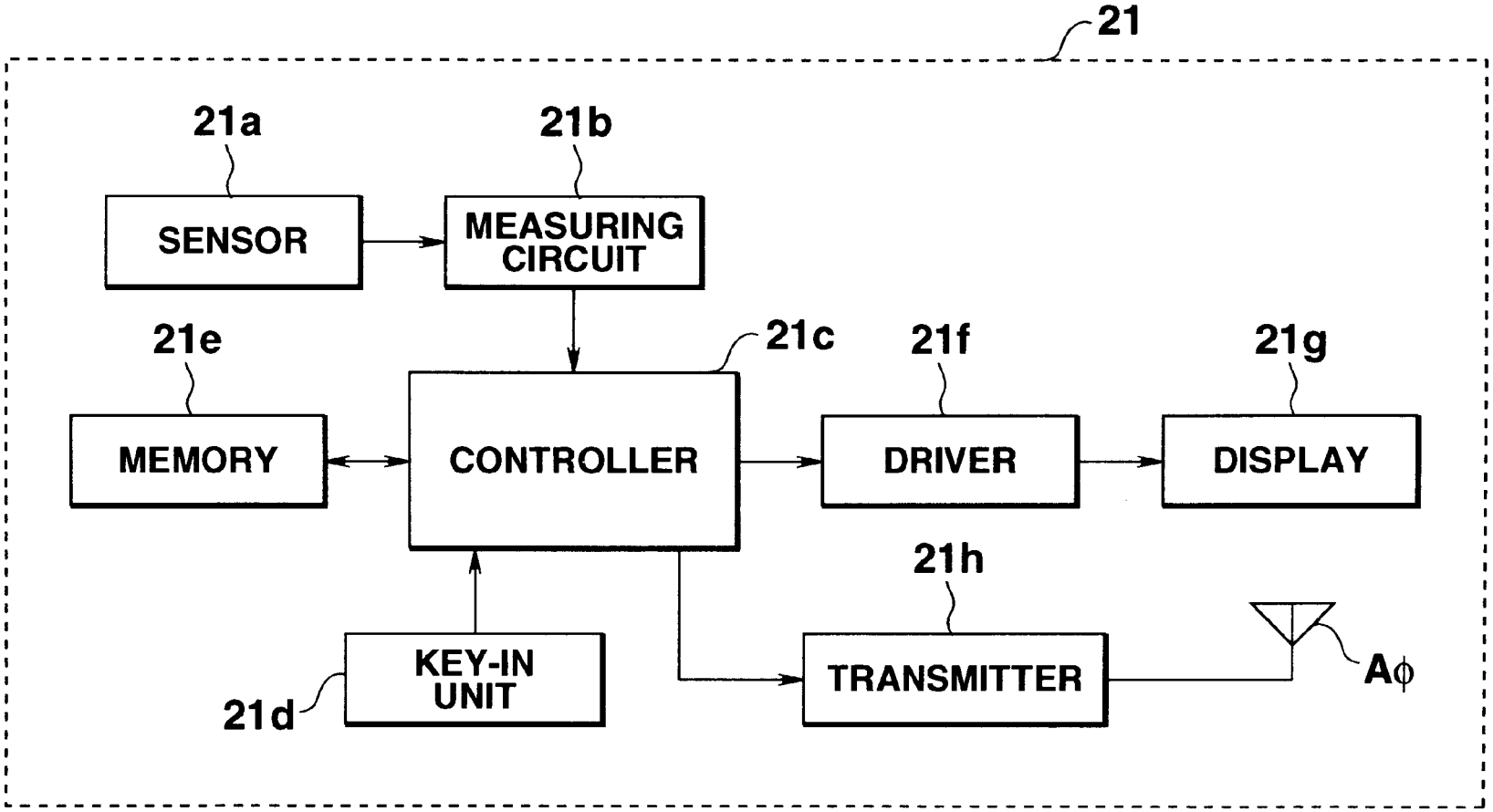
FIG. 3 is a block diagram of a measuring device 21 of FIG. 2.

In FIG. 3, reference numeral 21*a* denotes a sensor for an item to be measured. For example, a cuff, pressure sensor or an optical sensor is used as sphygmomanometer. Reference numeral 21*b* denotes a measuring circuit which appropriately amplifies the output of the sensor 21*a*, filters out possible noise contained in the sensor output, performs an A/D conversion on the filtered-out output, and then outputs the resulting living body data (for example, blood pressure data in the case of a sphygmomanometer).

A reference numeral 21*c* denotes a controller which includes a CPU, ROM, etc., and executes a control program stored in the ROM to control the respective elements concerned of the measuring device. The controller 21*c* has a timer function to measures or records time. Each time the controller 21*c* gets living body data, it adds measured time (timer value) data to the living body data and writes them into a memory (RAM) 21*e*, the register structure of which will be described later.

Reference numeral 21*d* denotes a key-in unit composed of a plurality of key switches such as a power source on/off key and a measurement start instructing key to thereby give key inputs depending on the respective operations of the key switches concerned to the controller 21*c*, which performs respective processing operations depending on the corresponding key inputs. Reference numeral 21*f* denotes a driver which drives a display unit 21*g* composed of an LCD panel depending on a display control signal delivered from the controller 21*c*. Reference numeral 21*h* denotes a transmitter which modulates data outputted from the controller 21*c* and then transmits the modulated data by radio from an antenna A0 to a patient terminal to be described in more detail later.

The data from the controller 21*c* is composed of living body data and data on a time difference DT obtained by calculation, which will be described later in more detail, and added to the living body data.

(3) Register Structure of Memory 21*e:*

Figure 4:
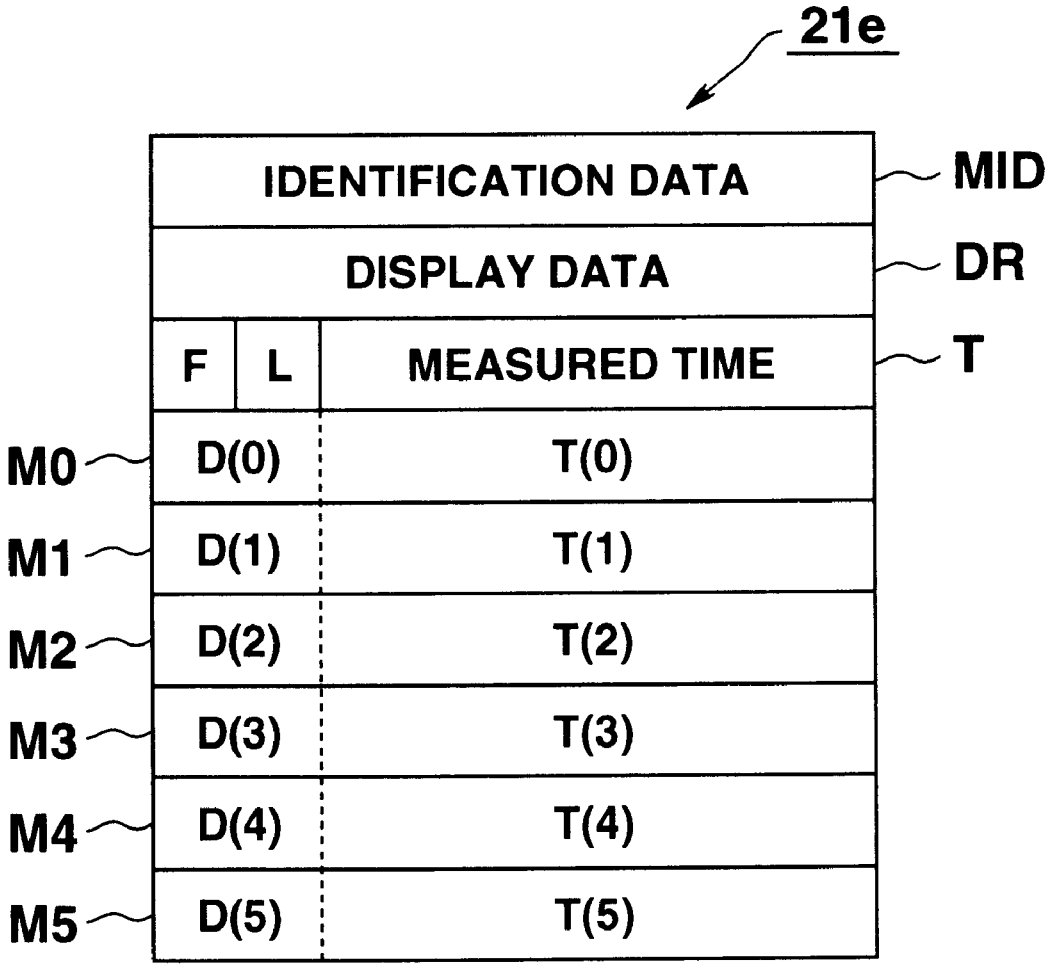
FIG. 4 shows a register structure of a memory 21*e* of the measuring device 21.

Referring to FIG. 4, the register structure of the memory 21*e* will be described next. In FIG. 4, reference character MID denotes a register which stores identification data representing items to be measured such as a patient's blood pressure, body temperature or cardiogram waveform.

Alternatively, without providing the register MID in the memory 21*e*, the identification data may be stored in the ROM (not shown) of the controller 21*c*.

A reference character DR denotes a display register which stores various display data displayed on the display unit 21*g*. Depending on the contents of the display register DR, the controller 21*c* generates a display control signal to be fed to the driver 21*f*. Reference character F denotes a measuring flag register in which "1" represents measurement whereas "0" represents stop of the measurement. Reference character L denotes a measurement count register which makes a round at a period of six measurements in this embodiment. The value of the measurement count register L also functions as an address pointer for data registers M0–M5 to be described later in more detail.

Reference character T denotes a time measurement register which stores a measured time (timer value) obtained by sequentially incrementing a timer clock which is obtained by dividing the frequency of an internal clock. The data registers M0–M5 store in corresponding relationship the measured living body data D(0)–D(5) and data on the respective time values (timer values) T(0)–T(5) when those living data D(0)–D(5) were measured. Data on the measured time values (timer values) T(0)–T(5) are referenced when time difference data DT to be added to the respective living body data D(0)–D(5) are calculated. The data in those data registers M0–M5 make a round at a period of six measurements and are thereafter overwritten sequentially with sequentially measured data.

Figure 5:
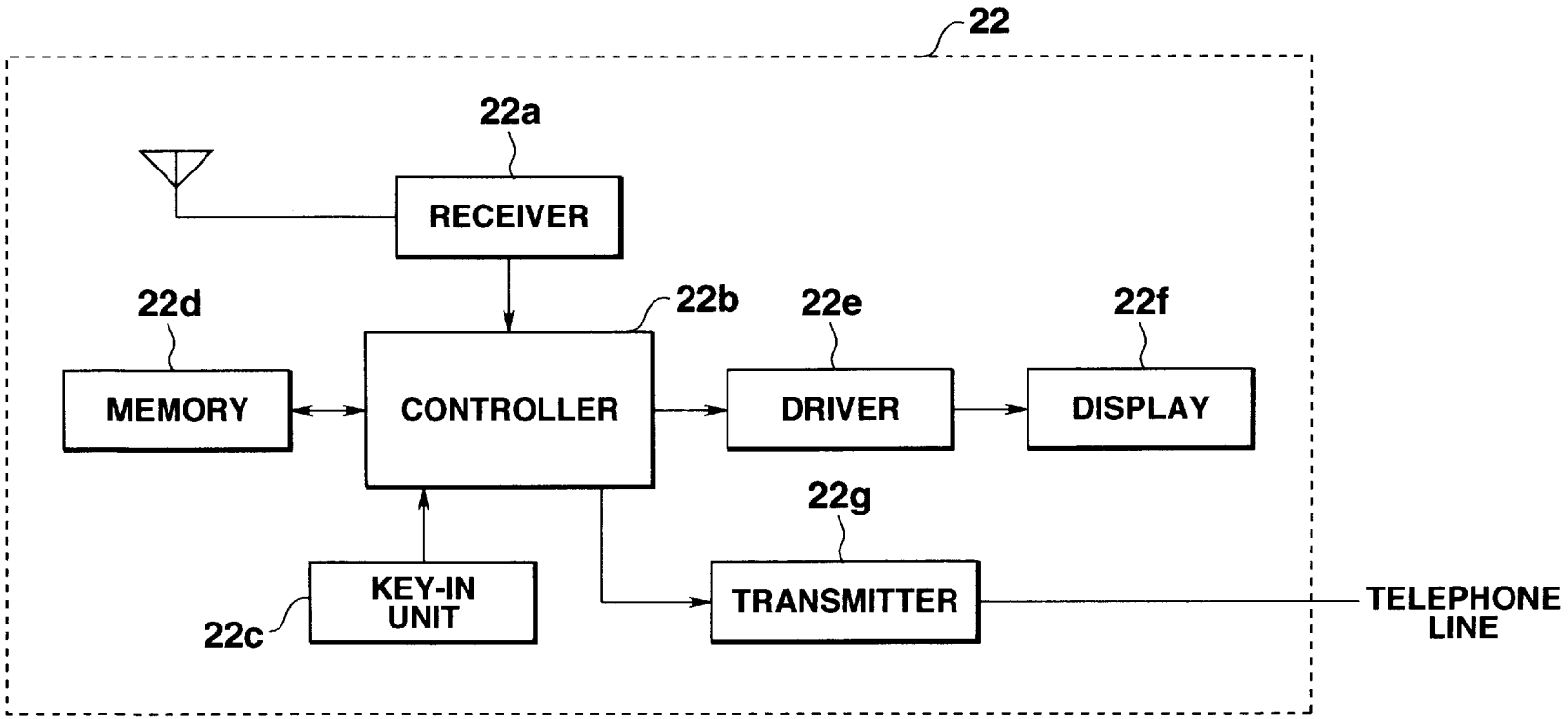
FIG. 5 is a block diagram of a patient terminal 22 of FIG. 2.

(4) Structure of Patient Terminal 22:

FIG. 5 is a block diagram of the structure of the patient terminal 22. In FIG. 5, reference numeral 22*a* denotes a receiver which receives through an antenna A1 and demodulates the data sent by radio from a measuring device 21. The demodulated data is inputted to the controller 22*b*, which is composed of a CPU, a ROM, etc., and controls the respective elements of the terminal.

The features of the operation of the controller 22*b* are that it separates the data fed from the receiver 22*a* into living body data and its time difference data DT, calculates on the basis of the time difference data DT the time when the living body data was measured, so that the living body data may be handled as a time-series history.

Reference numeral 22*c* denotes a key-in unit which includes a power source turn on/off key, a receive key which instructs the start of data receipt, a send key which instructs the start of data transmission, etc. A key input depending on the operation of each key is given to the controller 22*b*, which performs a processing operation depending on the key input.

Reference numeral 22*d* denotes a memory (RAM) used as a work area which temporality stores the respective data transmitted from the corresponding measuring devices 21-1 to 21-N or stores living body data of a time-series history to which the temporarily stored data is converted, under control of the controller 22*b*.

Reference numeral 22*e* denotes a driver which drives a display unit 22*f* composed of an LCD panel, depending on a display control signal from the controller 22*b*. Reference numeral 22*g* denotes a transmitter which FSK-modulates the data outputted from the controller 22*b* or the living body data to which the measurement time data is added, and transmits the resulting data over the general public line 1 to the host computer 3*a*.

(5) Register Structure of Memory 22*d:*

Figure 6:
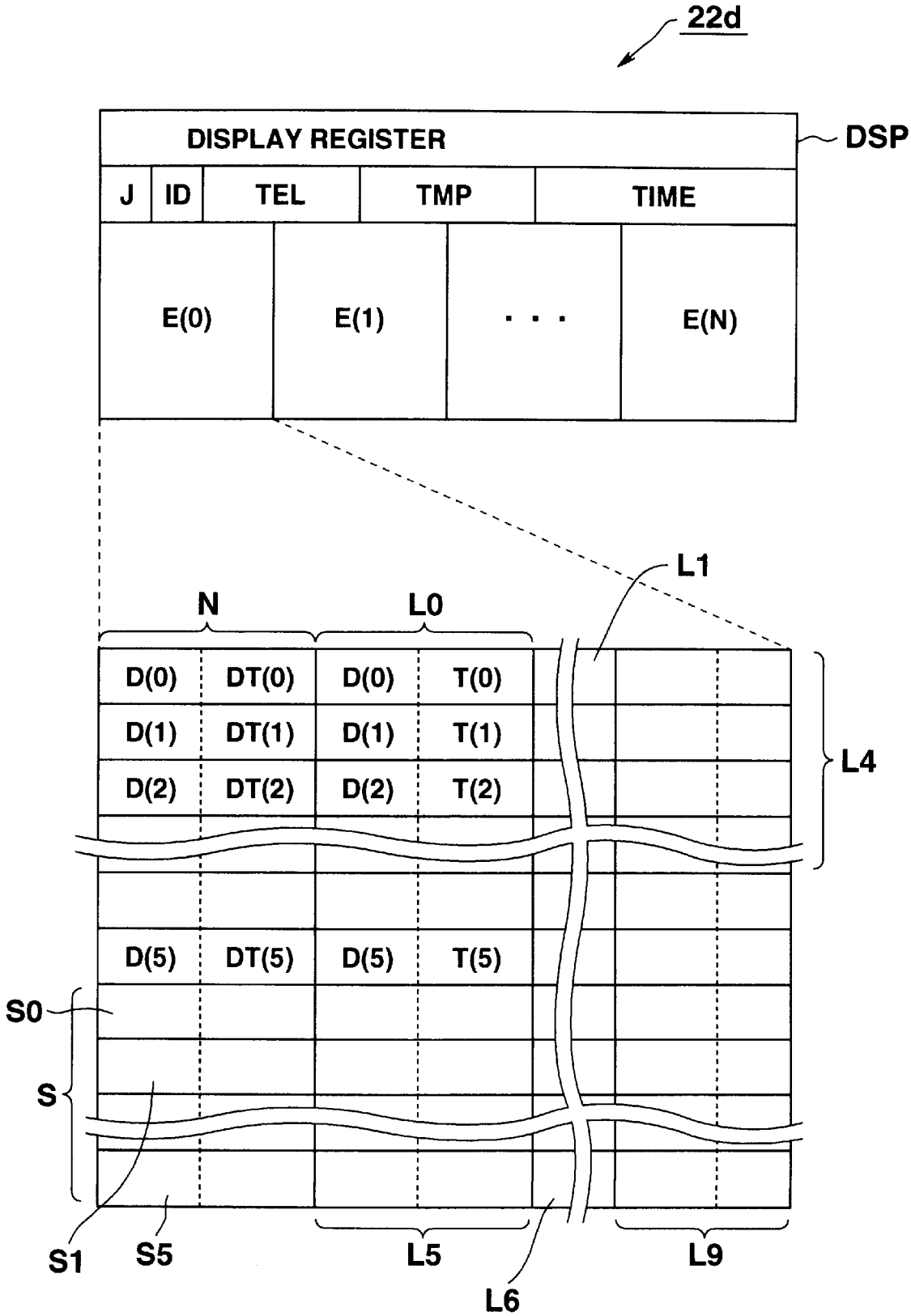
FIG. 6 is a register structure of a memory 22*d* of the patient terminal 22.

The register structure of the memory 22*d* will be described with reference to FIG. 6. In FIG. 6, reference character DSP denotes a display register which stores various display data to be displayed on the display unit 22*f*. Depending on the contents of the display register DSP, the controller 22*b* generates a display control signal to be fed to the driver 22*e*.

Reference character J denotes a transmit/receive flag register in which "1" represents transmission whereas "0" represents receipt. Reference character ID denotes a patient identification register which stores an identification code allocated to each patient. Reference character TEL denotes a register which stores the telephone number of a medical center to which the data is to be sent. Reference character TMP denotes an identification temporary storage register which stores identification data in a measuring device 21 to be received.

Reference character TIME denotes a current time register which records and stores the current time (date, time). Reference characters E(0)–E(N) denote measured data register areas provided for the respective measuring devices 21-1 to 21-N to store transmit data for the respective measurement items (for example, blood pressure, body temperature, pulses and cardiogram waveform) and time-series living body data whose measurement times are specified on the basis of the respective transmit data.

Each of the measured data register areas E(0)–E(N) has 11 storage areas N, L0, L2, L3, . . . , L9, and a transmission data area S. Received six pairs of time-series living body item data and corresponding time difference data D(0) and DT(0); D(1) and DT(1); D(2) and DT(2); D(3) and DT(3); D(4) and DT(4); and D(5) and Dt(5), transmitted by a single operation of a measuring device 21, are stored in the storage area N of six registers. The respective time difference data DT(0), DT(1), DT(2), . . . , DT(5) are converted to corresponding time data T(0), T(1), T(2), . . . , T(5) representing the times when the respective living body data were obtained. The resulting six pairs of time-series living body item data and corresponding time data D(0) and T(0); D(1) and T(1); . . . ; and D(5) and T(5) are stored in the storage area L1. The next received six pairs of time-series living body item data and corresponding time difference data D(0) and DT(0); D(1) and DT(1); D(2) and DT(2); D(3) and DT(3); D(4) and DT(4); and D(5) and Dt(5), transmitted by the next single operation of the measuring device 21, are similarly stored in the storage area N of six registers. The resulting six pairs of time-series living body item data and corresponding time data similar to those stored in the storage area L0 are now stored in the storage area Li and so forth. When the storage areas L0–L9 are sequentially filled with corresponding sequentially obtained groups of six pairs of time-series living body item data and time data D(0), T(0); D(1), T(1); D(2), T(2); D(3), T(3); D(4), T(4); and D(5), D(5), they are overwritten sequentially with subsequent sequentially obtained time-series groups of similar six pairs of time-series living body item data and time data, starting with the storage area L0.

The transmit data area S is composed of registers S0–S5 which store corresponding transmit data, which are transmitted over the telephone line to the medical center 3.

C. Operation of the Embodiment

Data transmission/receipt performed between a measuring device 21 and the patient terminal 22 will be described next with reference to FIGS. 7–9.

Figure 7:
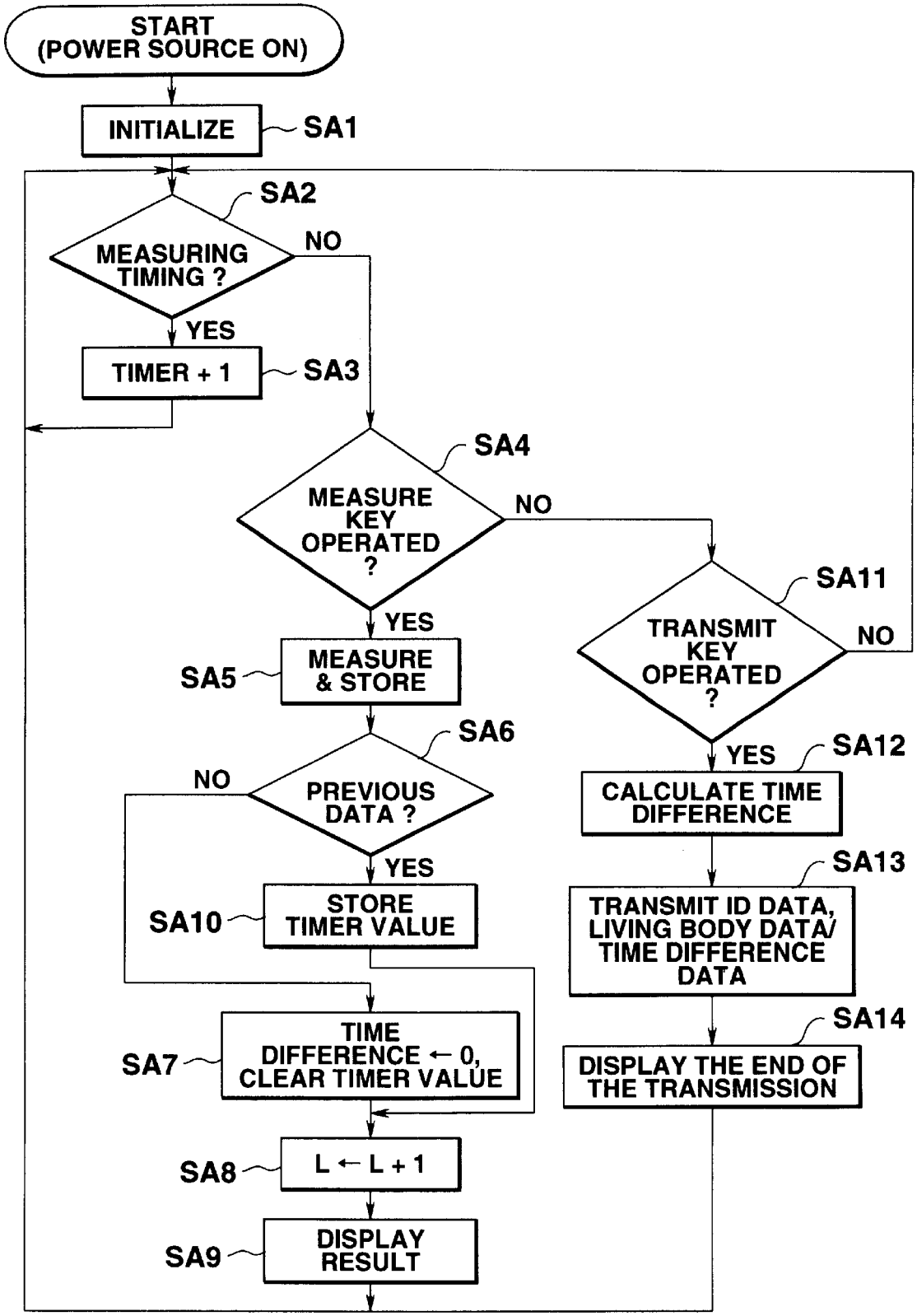
FIG. 7 is a flow chart indicative of a measuring routine performed by the measuring device 21.

(1) Operation of the Measuring Device 21:

First, when the power source turn/off key is operated in the measuring device 21 to turn on the power source, the controller 21*c* reads a predetermined control program from its internal ROM, and executes a measuring routine of FIG. 7 to advance its processing to step SA1, where the controller performs initialization which includes clearing to 0 data in the memory 21*e* and the respective internal registers or flag setting, and then advances its processing to step SA2. After step SA1, the controller 21*c* starts up its timer function to generate a timer clock, for example, at intervals of one second (not shown in FIG. 7).

(a) Accumulation of Timer Clocks:

The controller 21*c* advances its processing to step SA2, where the controller determines whether a time measuring timing has occurred or the timer clock has been detected. If so (YES at step SA2), the controller advances its processing to step SA3, where the controller increments by one the timer value in the time measuring register T of the memory 21*c* and then returns its processing to step SA2.

(b) Measurement:

When the time measuring timing has not occurred at step SA2 (NO), the controller advances its processing to step SA4, where the controller determines whether a measure key which instructs the start of the measurement has been operated. For example, when the measure key is operated in a state where the sensor 21*a* is set on the patient, the result of the determination at step SA4 becomes YES and the controller advances its processing to step SA5, where the controller performs measurement/storage.

More specifically, the signal measured by the sensor 21*a* is converted by the measuring circuit 21*b* to living body data D(0), which is then stored along with data on the measured elapsed time (time value) T(d) when the data D(0) was measured in the data register M0 (FIG. 4) of the memory 21*e* under the control of the controller 21*c*.

Thereafter, the controller 21*c* advances its processing to step SA6, where the controller determines whether there is any previous data. In this case, since the measurement is a first one, the result of the determination at step SA6 is NO, and the controller advances its processing to step SA7, where the controller clears the measured elapsed time data (timer value) T(0) stored in the data register M0, and hence the timer difference DT.

Subsequently, at step SA8, the controller 21*c* increments by one the value of the measurement count register L and sets an address pointer in the data register M1. Thereafter, the controller advances its processing to step SA9, where the controller 21*c* sets the living body data D(0) stored in the data register M0, in the display register DR to display the result of the measurement on the display unit. Then, the controller 21*c* again returns its processing to step SA2, and, when the time measuring timing has not occurred, then advances its processing to step SA4, where the controller determines whether the measure key is on. If so, the controller performs the next measurement/storage at step SA5.

For example, several hours later, when the measure key is again operated and the measurement is made, the controller performs the processing at step SA5 and then advances its processing to step SA6. In this case, the measurement is not the first one, so that the result of the determination at step SA6 becomes YES. The controller then advances its processing to step SA10, where the controller stores data on the measured elapsed time (timer value) T(1) when the second measurement was made, along with the corresponding living body data D(1) in the data register M1.

Thereafter, each time the measure key is operated, the above series of processes are repeated. Thus, the respective living body data D(2)–D(5) and corresponding measured time values (timer values) T(2)–T(5) are sequentially stored in the data registers M2–M5 of the memory 21*e*.

(c) Transmission:

At the end of the day when those measured respective living body data D(2)–D(5) and corresponding measured time values (timer values) T(2)–T(5) are stored in the memory 21*e*, as mentioned above, the transmit key which instructs the start of data transmission is operated to send those data to the patient terminal 22. At step SA11, the controller determines whether the transmit key has been operated.

If so (YES at step SA11), the controller advances its processing to step SA12, where the controller performs a time difference calculation process which includes subtraction of the respective second-sixth measured elapsed times when the corresponding living body data were measured from the elapsed time measured in the time measurement register T representing the starting of the data transmission to obtain the corresponding time differences DT(1)–DT(5), and replacement of the measured time values T(1)–T(5) with the corresponding time differences DT(1)–DT(5) in the memory 21*e*.

The controller then advances its processing to step SA13, where it transfers to the transmitter 21*h* the identification data MID, living body data D(0)–D(5), and corresponding time difference data DT(0)–DT(5), stored in the memory 21*e* and the transmitter 21*h* transmits by radio those data and data on the number of those data pairs to the patient terminal 22 by radio such that the respective pairs of data D(0), DT(0); D(1), DT(1); D(2), DT(2); . . . ; D(5), DT(5) may be recognized separately.

The controller then advances its processing to step SA14, where the controller displays on the display unit 21*g* that the transmission has ended, and then returns its processing to step SA2.

Figure 8:
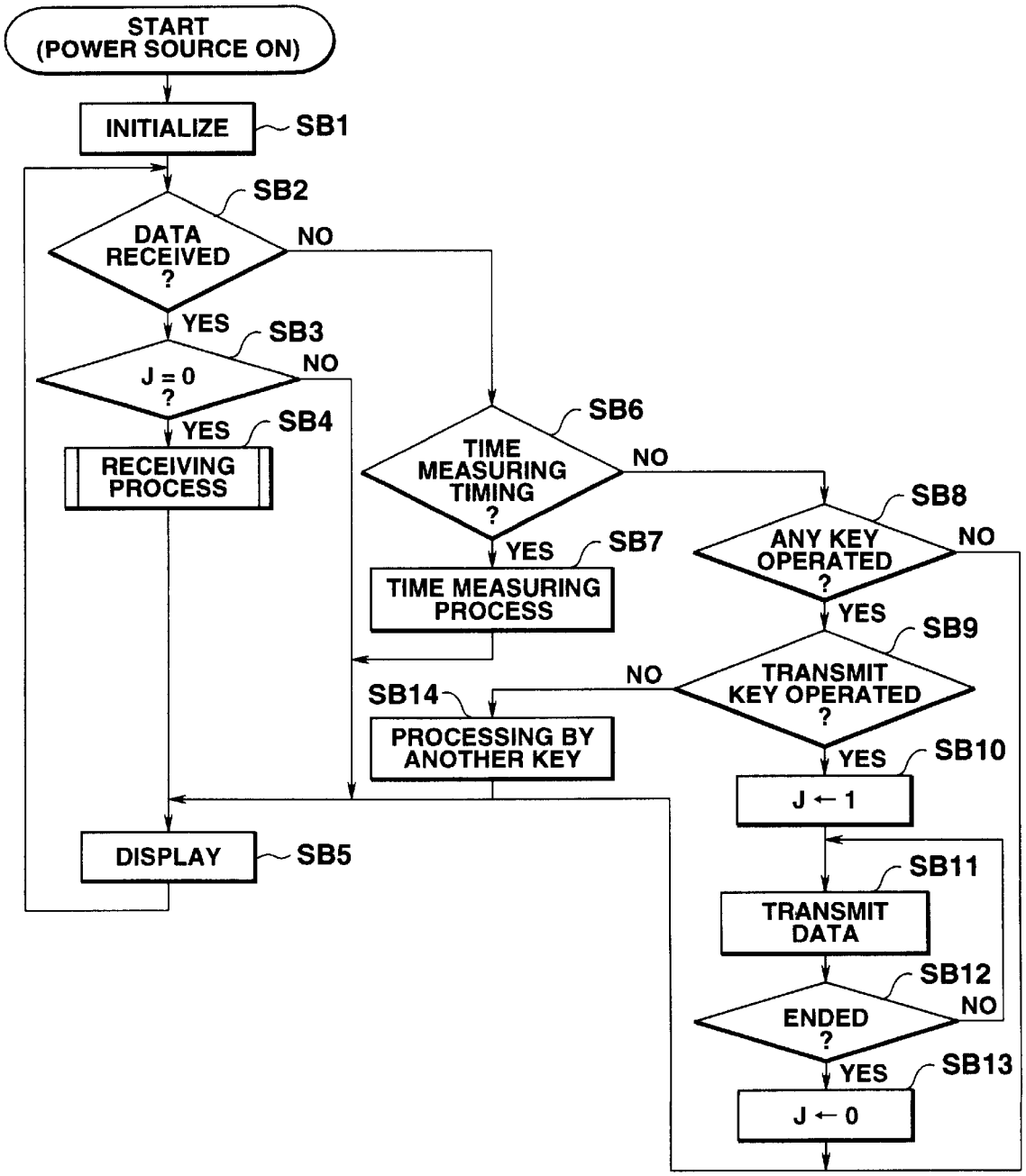
FIG. 8 is a flow chart indicative of a terminal processing routine performed by the patient terminal 22.
Figure 9:
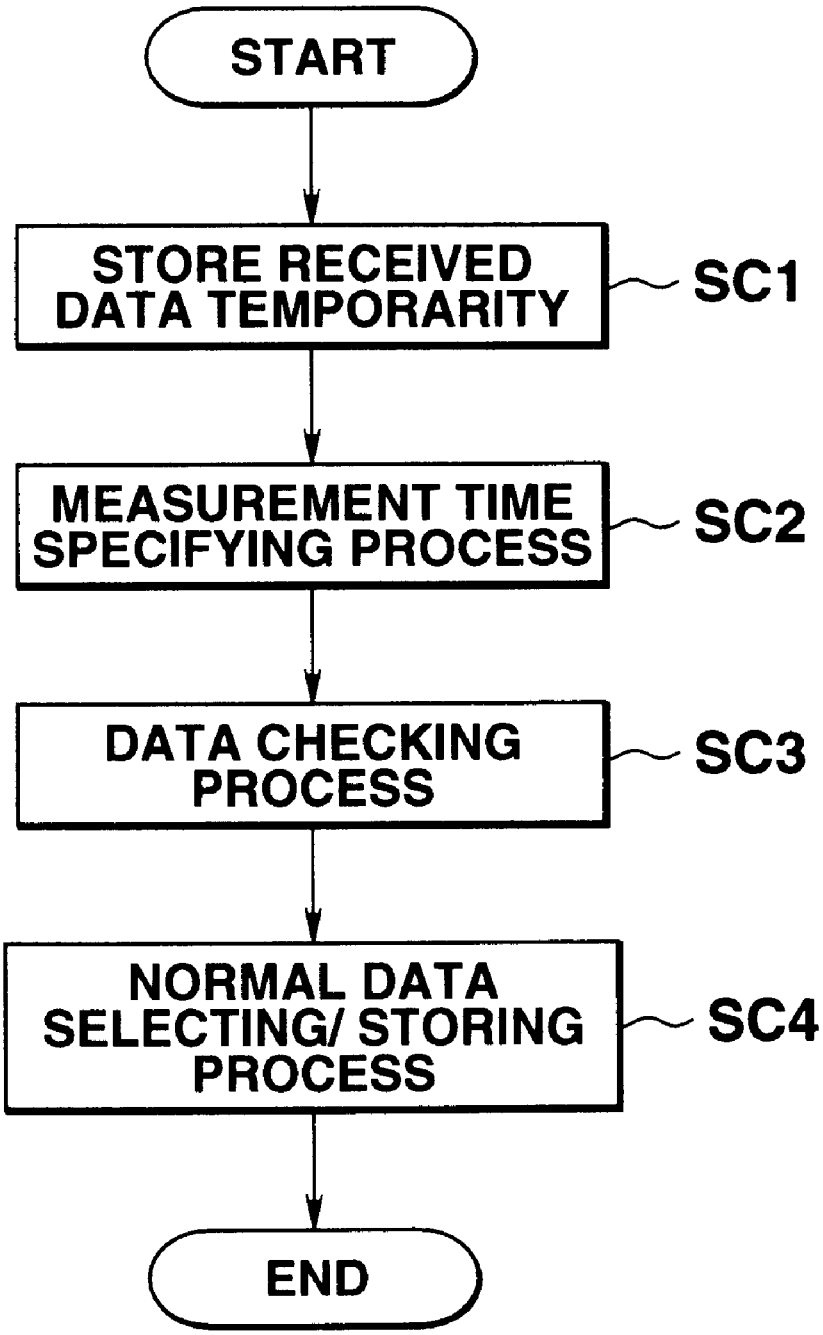
FIG. 9 is a flow chart indicative of a receiving routine performed by the patient terminal 22.

(2) Operation of Patient Terminal 22:

Referring to FIGS. 8 and 9, the operation of the patient terminal 22 will be described next. When the power source turn on/off key is operated in the patient terminal 22 to turn on its power source, the controller 22*b* reads a predetermined control program stored in its internal ROM and executes a terminal processing routing of FIG. 8. First, the controller advances its processing to step SB1, where the controller performs initialization which includes clearing the memory 22*d* and the respective internal registers of the terminal 22 and/or flag setting, and then advances its processing to step SB2.

(a) Operation in a Receipt Mode:

When the controller advances its processing to step SB2, it determines whether there is any received data. If so, the controller advances its processing to step SB3, where the controller determines whether the transmit/receive flag J is "0" or a receive mode has been set by the operation of the transmit/receive mode switching key. If so, the result of the determination at step SB3 becomes YES, and the controller advances its processing at step SB3, where the controller performs the receiving process at step SB4 as shown by a receiving process routine of FIG. 9.

When the receiving process routine of FIG. 9 is started up, the controller 22*b* advances its processing to step SC1, where the controller temporarily stores in the memory 22*d* the data transmitted by the measuring device 21 and received by the receiver 22*a*. More specifically, of the received data, the controller stores the identification data MID in the identification temporary storage register TMP, and living body data D(0)–D(5) and corresponding time difference data DT(0)–DT(5) in the received data storage area N (FIG. 6) of the appropriate one of the measurement register areas E(0)–E(N) corresponding to the identification data MID.

The controller 22*b* then advances its processing to step SC2, where the controller sequentially reads the time difference data DT(0)–DT(5) stored in the received data storage area N, subtracts corresponding respective time differences from the current time whose data is recorded in the current time register TIME, specifies the times T(0)–T(5) when the respective living body data D(0)–D(5) are measured and replaces the respective data on the time difference DT(0)–DT(5) data stored in the received data storage area N with the times T(0)–T(5).

The living body data D(0)–D(5) and the corresponding specified measurement time T(0)–T(5) data added to the former data D(0)–D(5) are transferred to and stored in the transmission data area S (FIG. 6).

At step SC3, the controller performs a data checking process to find abnormalities between the received time-series data in a conventional manner.

At step SC4, if the data checking process clarifies that the living body data D(0)–D(5) and the corresponding measured times are normal and can be handled as a time-series history, the controller sequentially stores those data as correct in any appropriate one of the storage areas L0–L9. Thereafter, the controller 22*b* returns its processing to the terminal processing routine of FIG. 8. In this routine, the controller advances its processing to step SB5, where the controller displays the normal data obtained in the receiving routine on the display unit 22*f*. Thereafter, the controller 22*b* again advances its processing to step SB2.

(b) Time Recording/Measuring Process:

When there is no received data, the result of the determination at step SB2 is NO, and the controller advances its processing to step SB6, where the controller determines whether the time measuring timing has occurred. If so, the result of the determination at step SB6 becomes YES and the controller advances its processing to step SB7, where the controller increments the data in the current time register TIME of the memory 22*d* to update the current date and time (hours, minutes, seconds), updates the display register accordingly, and at step SB5, displays the current date and time on the display unit 22*f*.

(c) Operation in a Transmission Mode:

When the controller determines at step SB6 that the time measuring timing has not occurred (NO at step SB6), the controller advances its processing to step SB8, where the controller determines whether there is any key operated.

When the transmit key is operated to transmit to the medical center 3 (FIG. 1) normal data for the respective measurement items obtained by the receiving routine, the result of the determination at step SB8 becomes YES. Thus, the controller advances its processing to step SB9, where the controller determines whether the transmit key has been operated. In this case, since the transmit key has been operated, the result of the determination at step SB9 becomes YES and the controller advances its processing to step SB10.

When a key other than the transmit key is operated, the controller advances its processing to step SB14, where the controller performs a process corresponding to that operated key.

At step SB10, the controller sets the transmit/receive flag J at "1" in accordance with the operation of the transmit key. Thereafter, at step SB11, the controller performs a transmitting process in which the normal data or six pairs of living body data D(0)–D(5) and corresponding added measured time T(0)–T(5) data which can be handled as a time-series history stored in the registers S0–S5 of the area S are transmitted to the medical center 3 along with identification data which identify the respective measurement items and identification code of the register ID which identify the patient.

In the data transmission, the telephone number of the medical center 3 stored in the register TEL of the memory 22*d* is automatically dialed to establish communication with a predetermined protocol, and those data are then up loaded.

When the data transmission ends, the controller receives an up-load end signal as acknowledge signal from the medical center 3, and the result of the determination at step SB12 about whether the data transmission has ended becomes YES. The controller then advances its processing to step SB13, where the controller sets the transmit/receive flag J at "0" and hence sets the receive mode. Thereafter, the controller 22*b* returns its processing to step SB2 to repeat the process of FIG. 8.

As described above, according to the above embodiment, the measuring device 21 adds the time difference DT data to the measured living body data and outputs the resulting data by radio. The patient terminal 22 specifies the time when the living body data were measured on the basis of the received time difference data DT. Thus, the transmitting end is capable of storing and transmitting data on the time when the data to be transmitted were obtained, without providing current time measuring means at the transmitting end.

As described above, in the present embodiment, the transmitting end (measuring device) has been illustrated as calculating the time difference between the time when the living body data were measured and the time when the measured data were transmitted and then transmitting the time difference data. If the transmitting end transmits data on the time in the time measuring register T when the living body data were measured and data on the time in the time measuring register T when the living body data, etc., were transmitted, the receiving end (patient device) will be able to calculate the time difference and calculate/specify the time where the living body data were measured.

Alternatively, the transmitting end may store the time data in the time measuring register T where the living body data were measured until the transmission time, subtract the time in the time recording register T when the living body data were measured from the time in the time recording register T when the living body data, etc., are transmitted, and transmit data on the resulting time difference to the receiving end.

While in the present embodiment, specifying the measured time at the receiving end has been illustrated, current time recording means which is not required to be synchronized with the time recording means provided at the receiving end may be provided at the transmitting end. For example, arrangement may be such that the measuring device 21 transmits to the receiving end data on the time T2 when the living body data were measured and data on the time T1 when the living body data are transmitted while the patient's device 22 calculates the time on the side of the receiving end corresponding to the time when the living body data were measured on the basis of the time difference (T1–T2). In this case, as in the above embodiment, the patient's living body data can be handled as a time-series history as well as synchronization between the measuring device 21 and the patient terminal 22 becomes useless.

Figure 10:
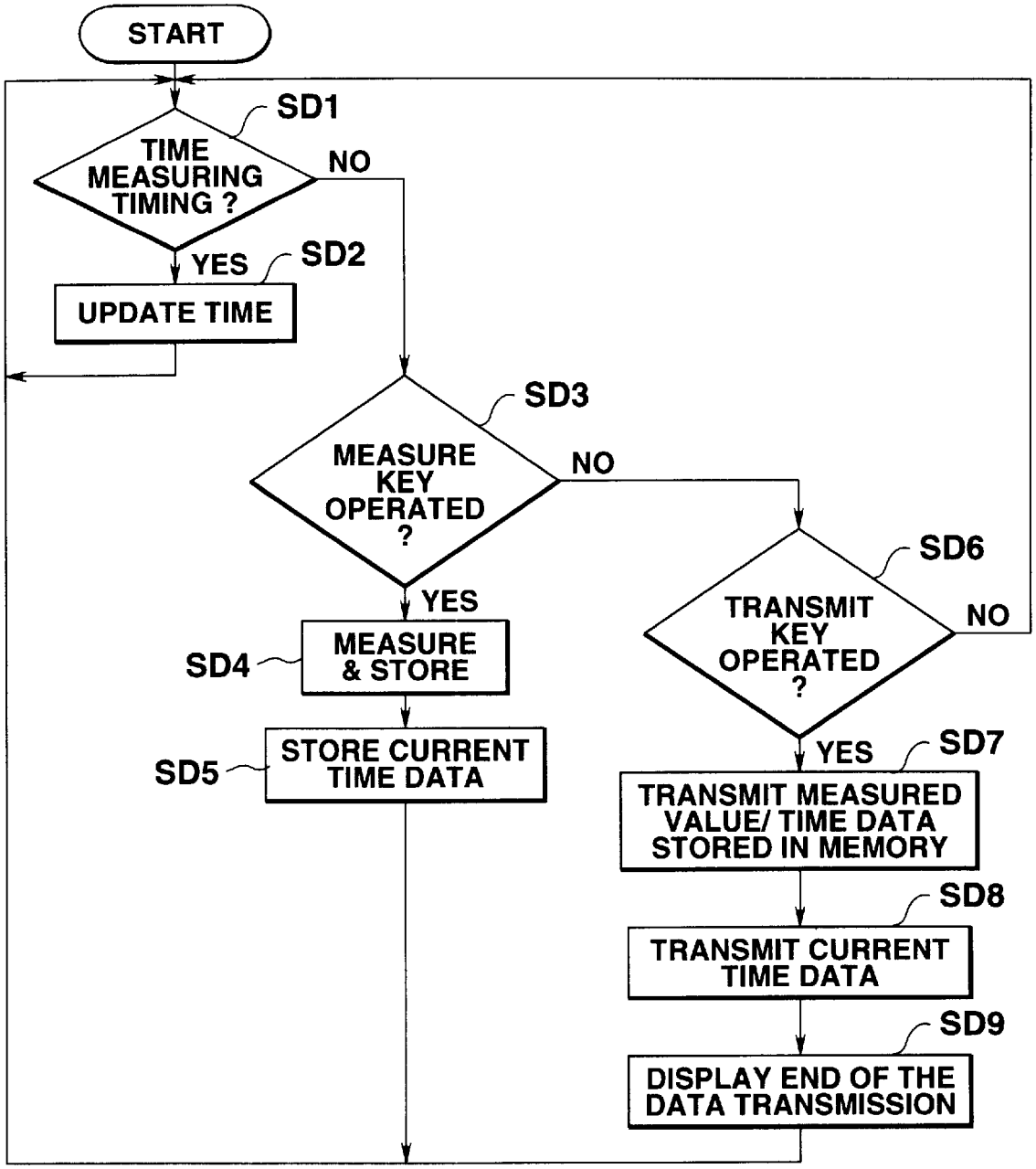
FIG. 10 is a flow chart indicative of an operation performed by a modification of the measuring device 21.
Figure 11:
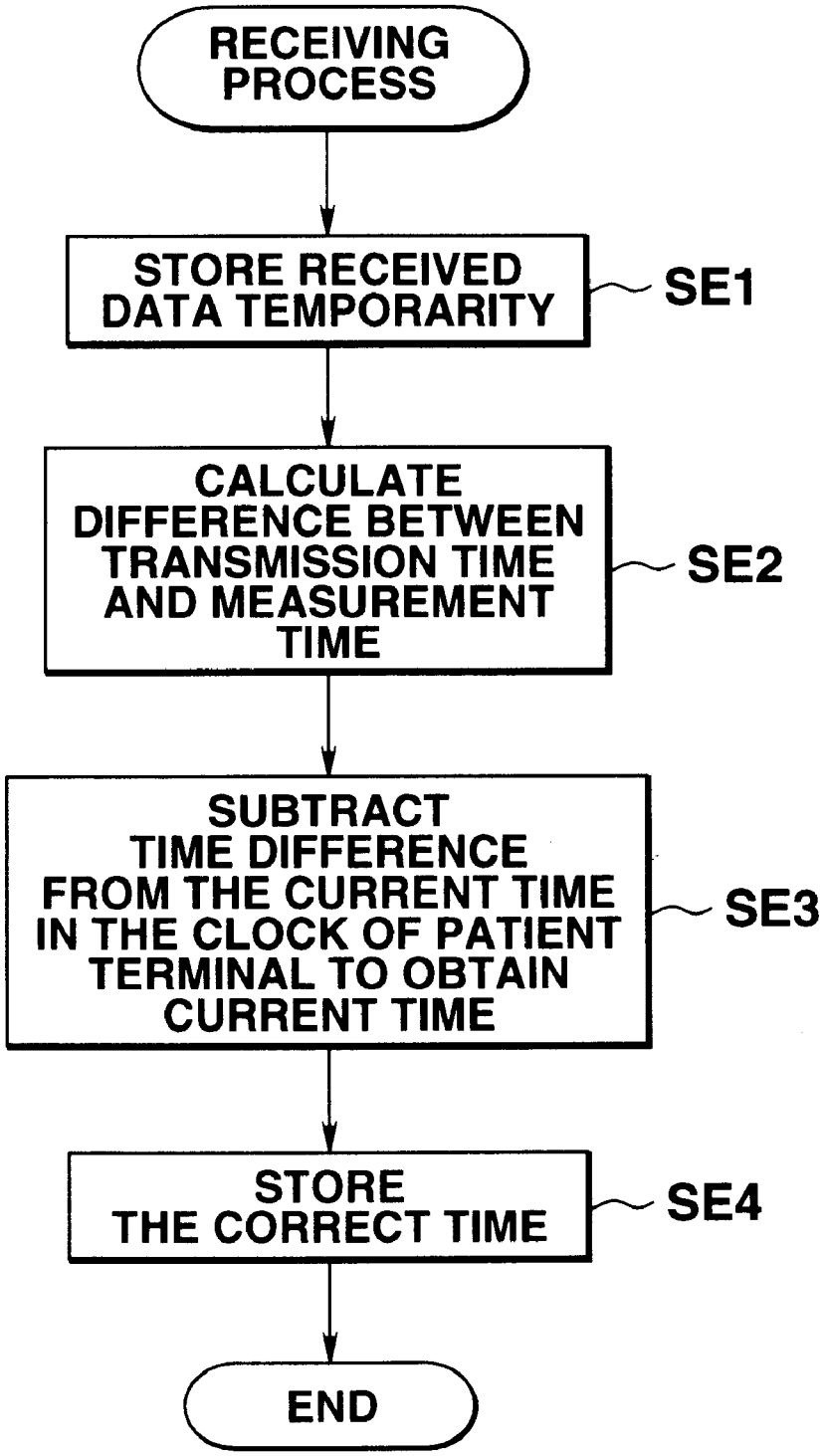
FIG. 11 is a flow chart indicative of a receiving process performed by a modification of the patient's device 22.

This arrangement will be described next with reference to FIGS. 10 and 11. FIG. 10 shows a flow chart indicative of the operation of the measuring device 21 whereas FIG. 11 shows a flow chart indicative of the receiving process of the patient terminal.

The power source of the measuring device 21 is always on and the process shown by the flow chart of FIG. 10 is always executed. At step SD1, the controller determines whether the time measuring timing has occurred. If so, the controller advances its processing to step SD2, where the controller updates the current time data in the current time register TIME.

When the controller determines NO at step SD1, the controller advances its processing to step SD3, where the controller determines whether the measure key has been operated. If so, the controller advances its processing to SD4, where the controller performs a data measuring/storing operation. Thereafter, the controller advances its processing to step SD5, where the controller stores in the memory the time in the current time register TIME when the living body data was measured/stored, in correspondence to the measured data.

When the transmit key is operated, the controller determines at step SD6 that the transmit key has been operated, and the controller advances its processing to step SD7, where the controller transmits the measured data and the data on the time when the data was measured, both being stored in the memory. In this case, if a plurality of such measured data are stored, those data are transmitted along with the respective times where those data were measured. Thereafter, the controller advances its processing to step SD8, where the controller transmits the current time data stored in the current time register. Thereafter, the controller advances its processing to step SD9, where the controller displays that the data transmission has ended.

In the receiving process performed by the patient terminal 22, the controller first stores received data temporarily at step SE1. At step SE2, the controller calculates from the received data the time differences between the time when the measured data were transmitted and the respective times when the living body data were measured. Thereafter, the controller advances its processing to step SE3, where the controller subtracts the time difference calculated at step SE2 from the current time in the clock of the patient terminal to obtain the accurate time when the living body data were measured, and then stores the measured data and corresponding data on the obtained accurate measurement time.

While in the present embodiment, specifying the time when the living body data was measured has been illustrated, the present invention is not limited to this particular case, and various changes and modification are possible. For example, by using a timepiece such as a stopwatch which has the function of storing a timer value, the time when some operation was performed may be specified on the basis of the stored timer value.

In addition, even in a dive computer, an orientation timer or a marathon timer, a time difference between a stored timer value and the current measured time may be calculated and the time when the timer value was stored can be obtained. Even a well-known pager may similarly specify the time when the data was obtained.

The present invention is also applicable even in the field of security. For example, a system is considered in which (1) when a possible intruder is monitored, using a security camera, the occurrence of an intrusion is detected from a change in the image in a camera, and (2) the time when this change occurred is specified and stored along with the image at that time.

In addition, in a system where a visitor is ascertained using an intercom system having a pickup camera, data on the time when the intercom system is operated and a visitor's face image picked up at that time may be stored in a memory. In such a system, when an image is read from the memory for confirming purposes, the time when the image was previously stored in the memory is specified on the basis of the timer time when the image was stored in the memory and the timer time when the image data was read from the memory.

Finally, the present invention is also applicable to well-known digital cameras. For example, on the basis of a stored timer time when an image was picked up, the time when the picked-up image was printed out or displayed can be known.

What is claimed is:

1. An electronic device including a transmitter and a receiver, wherein:

(i) said transmitter comprises:

elapsed time measuring means for measuring an elapsed time which has elapsed since a set point of time;

time information storing means for storing information on a plurality of elapsed times;

storage controlling means, responsive to a user performing a specified process, for controlling said elapsed time measuring means to measure a particular elapsed time related to the specified process at a time that the specified process is performed by the user, and for controlling said time information storing means to store the particular elapsed time related to the user-performed specified process; and controlling/transmitting means, responsive to an instruction of transmission input by the user, for calculating information on a plurality of time differences each between the particular elapsed time measured by said elapsed time measuring means when the instruction of transmission was input by the user and a respective one of the plurality of elapsed times whose information is stored in said time information storage means, and for transmitting to said receiver information on the calculated plurality of time differences; and (ii) said receiver comprises:

current time measuring means for measuring a reference signal to obtain information on a current time;

receiving means for receiving the information on the transmitted plurality of time differences; and calculating means for calculating a plurality of times at which the specified process was performed by said transmitter, based on the information on the plurality of time differences received by said receiving means and information on the current time obtained by said current time measuring means.

2. The electronic device according to claim 1, wherein said transmitter further comprises measuring means for measuring human body data, and wherein the specified process comprises a process for measuring living body data using said measuring means.

3. The electronic device according to claim 2, wherein said controlling/transmitting means comprises means for transmitting to said receiver the living body data.

4. The electronic device according to claim 1, wherein said receiver further comprises means for transmitting outside information on the plurality of times calculated by said calculating means.

5. An electronic device including a transmitter and a receiver, wherein:

(i) said transmitter comprises:

elapsed time measuring means for measuring an elapsed time which has elapsed since a set point of time;

time information storing means for storing information on a plurality of elapsed times;

storage controlling means, responsive to a user performing a specified process, for controlling said elapsed time measuring means to measure a particular elapsed time related to the specified process at a time that the specified process is performed by the user, and for controlling said time information storing means to store the particular elapsed time related to the user-performed specified process; and transmitting means, responsive to an instruction of transmission input by the user, for transmitting to said receiver means the information on the particular elapsed time and the information on the plurality of elapsed times stored in said time information storing means; and (ii) said receiver comprises:

current time measuring means for measuring a reference signal to obtain information on a current time;

receiving means for receiving from said transmitter the information on the particular elapsed time and the information on the plurality of elapsed times stored in said time information storing means; and calculating means for calculating a plurality of times when the specified process was performed, based on the received information on the particular elapsed time, the received information on the plurality of elapsed times, and the information on the current time obtained by said current time measuring means.

6. The electronic device according to claim 5, wherein said transmitter further comprises measuring means for measuring human body data, and wherein the specified process comprises a process for measuring living body data using said measuring means.

7. The electronic device according to claim 6, wherein said transmitting means comprises means for transmitting to said receiver means the living body data.

8. The electronic device according to claim 5, wherein said receiver further comprises means for transmitting information on the plurality of times calculated by said calculating means.

* * * * *